US005533454A

United States Patent [19]

Ellis et al.

[11] Patent Number: 5,533,454

[45] Date of Patent: Jul. 9, 1996

[54] ALTERNATING CURRENT ACTIVATED FIRING CIRCUIT FOR EBW DETONATORS

[75] Inventors: James Ellis; Alan W. Crawford, both of Houston, Tex.

[73] Assignee: Western Atlas International, Inc., Houston, Tex.

[21] Appl. No.: 529,556

[22] Filed: Sep. 18, 1995

Related U.S. Application Data

[63] Continuation-in-part of Ser. No. 276,719, Jul. 18, 1994, abandoned.

[51] Int. Cl.[6] ..... F42C 19/12

[52] U.S. Cl. ..... 102/202.1; 102/202.7; 102/218

[58] Field of Search ..... 102/311, 312, 102/313, 200, 202.1, 202.2, 202.3, 202.4, 202.7, 217, 218; 361/247, 248, 249, 251

[56] References Cited

U.S. PATENT DOCUMENTS

| | | | |
|---|---|---|---|
| 4,685,396 | 8/1987 | Birse et al. | 102/200 |
| 4,762,067 | 8/1988 | Baker et al. | 102/202.4 |
| 4,779,532 | 10/1988 | Riley et al. | 102/202.2 |

*Primary Examiner*—Daniel T. Pihulic
*Attorney, Agent, or Firm*—Richard A. Fagin

[57] ABSTRACT

The invention is a firing circuit for an exploding bridgewire explosive detonator which is activated only by application of an alternating current of a preselected frequency. The firing circuit comprises a bandpass filter, a voltage multiplier, and a discharge circuit.

The invention can be configured to selectively detonate a plurality of exploding bridgewire detonators by assembling a plurality of firing circuits for each exploding bridgewire, each firing circuit having a bandpass filter with a different preselected frequency.

6 Claims, 4 Drawing Sheets

34
30
12
14
18
16
25
24
10
22
20
13

ALTERNATING CURRENT ACTIVATED FIRING CIRCUIT FOR EBW DETONATORS

CROSS REFERENCE TO RELATED U.S. PATENT APPLICATIONS

The present application is a continuation-in-part of U.S. patent application Ser. No. 08/276,719 filed on Jul. 18, 1994, now abandoned and assigned to the assignee of the present invention.

BACKGROUND OF THE INVENTION

1. Field of the Invention

The present invention is related to the field of detonators for high explosive devices. More particularly, the present invention is related to the field of firing circuits, or activating devices, for safely initiating exploding bridgewire (EBW) detonators.

2. Description of the Related Art

EBW detonators are used to initiate chemical high-explosive devices. EBW detonators provide a substantial improvement in safety when compared with conventional electrically-activated detonators. EBW detonators are insensitive to mechanical impact and are immune to accidental firing caused by spurious electromagnetic (EM) radiation and stray voltages. Sources of spurious EM radiation and stray voltages can include electrical equipment such as radios, arc welding devices, electric motors and power lines.

An EBW detonator is typically activated by a specialized firing circuit, which should be capable of discharging a detonating current of about 1500 volts and 800 amperes in a time of about 1 microsecond. Generally, EBW firing circuits are activated by a power source having a much lower average voltage and current than the detonating current. The lower voltage power source typically charges a capacitor, or other similar energy storage device over a relatively long time period, such as five to fifteen seconds. The capacitor is then rapidly discharged through the EBW detonator when the voltage reaches a predetermined threshold, thereby generating the detonating current.

While the EBW detonator itself is relatively immune to accidental initiation by spurious EM radiation and stray voltages, the firing circuit also must be substantially immune to unintended activation by spurious EM radiation and stray voltage in order to realize the safety benefit of the EBW detonator.

One of the applications for EBW detonators is for initiating oil well perforating guns. EBW detonators are desirable for use in oil well perforating guns because a typical oil well has many nearby sources of spurious EM radiation. Safety of personnel at the oil well would require shut down of electrical equipment and telecommunications equipment near the oil well if conventional detonators were used. This can be expensive and inconvenient, particularly at offshore oil wells.

It is an object of the present invention to provide a firing circuit for EBW detonators which is insensitive to accidental initiation by spurious EM radiation or accidental application of stray electrical voltage to the detonating cable.

It is another object of the present invention to provide a firing circuit which can be used to individually activate more than two separate EBW detonators in an assembly comprising a plurality of EBW detonators.

SUMMARY OF THE INVENTION

The present invention is a firing circuit for EBW detonators which is activated by an alternating current of a preselected frequency. The firing circuit comprises a bandpass filter which blocks all current applied to the circuit except at the preselected frequency, a voltage multiplier which increases the applied voltage to a level sufficient to fire the detonator, and a discharge circuit which stores the firing energy until the voltage has reached a level sufficient to initiate the EBW detonator.

DESCRIPTION OF THE PREFERRED EMBODIMENT

Figure 1:
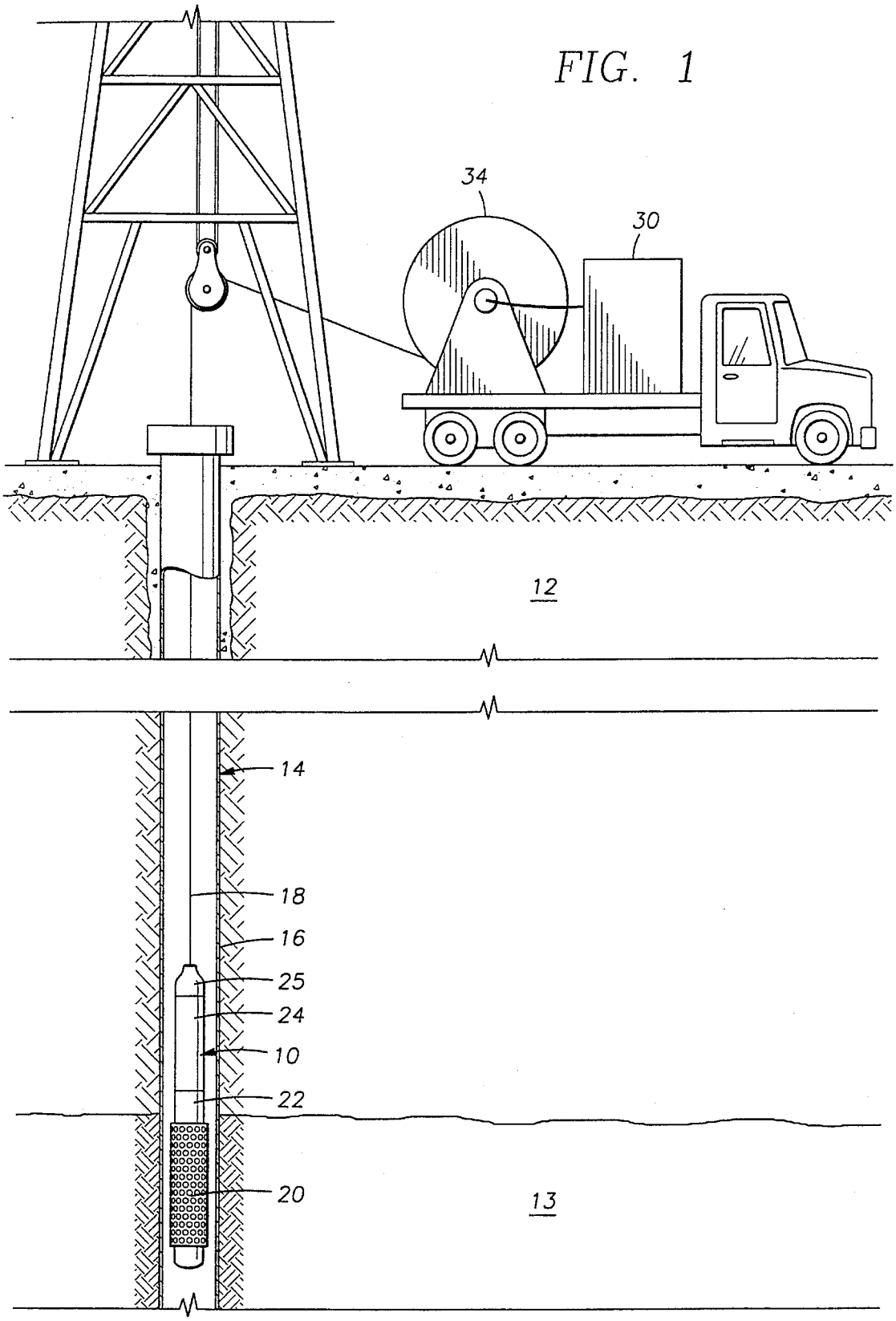
FIG. 1 shows the present invention as it is typically used in an oil well perforating gun assembly.

FIG. 1 shows the present invention as it is typically used in combination with an oil well perforating gun assembly. An oil well 14 is drilled through earth formations 12 until a desired formation 13, which may contain oil and gas, is penetrated. The well 14 is then "completed" by inserting therein a steel casing 16 and cementing it in place to hydraulically isolate the desired formation 13 from other portions of the earth formations 12.

A perforating gun assembly 10 is lowered into the well 14, typically by means of an armored electrical cable 18 comprising at least one insulated electrical conductor (not shown). The cable 18 is lowered into the well 14 by means of a winch 34 or other device known in the art until the gun assembly 10 is positioned at the depth of the desired formation 13.

The gun assembly 10 includes the firing circuit 24, an EBW detonator and booster 22, and explosive shaped charges disposed in a carrier assembly 20. The gun assembly 10 is attached to the cable 18 by a cable head 25, which makes both electrical and mechanical connections from the assembly 10 to the cable 18.

When so controlled by the system operator, a surface control unit 30 applies an electrical voltage to the cable 18 to initiate the firing circuit 24, thereby detonating the EBW detonator and booster 22, which detonates the gun assembly 10.

Figure 2:
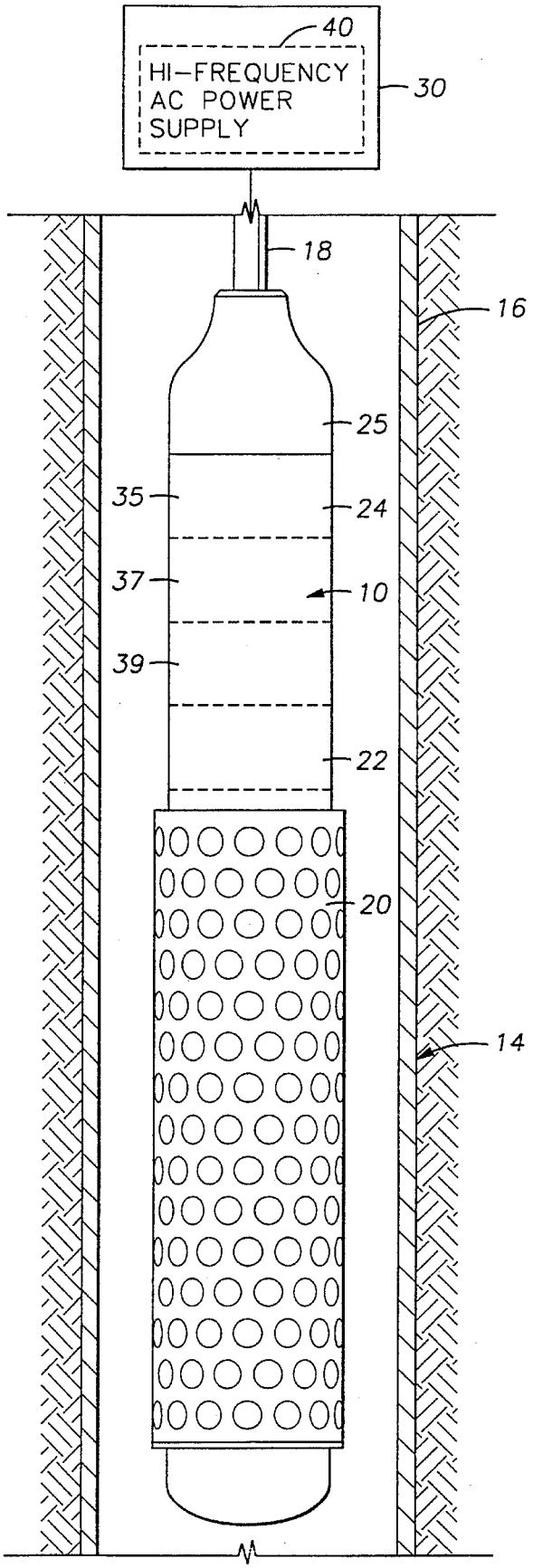
FIG. 2 shows the functional components of the present invention in combination with the oil well perforating gun assembly.

FIG. 2 shows the perforating gun assembly 10 as a functional block diagram. The surface control unit 30 includes a high voltage AC power supply 40 which, by control of the equipment operator, applies power at a preselected frequency to the cable 18 for activating the firing circuit 24.

The functional components of the firing circuit 24, shown in FIG. 2, include a bandpass filter 35, a voltage multiplier 37, and a discharge circuit 39. The response characteristics of the bandpass filter 35 will be further explained. In the present embodiment of the invention, the circuits 35, 37, 39 can be combined in a single assembly (shown as the firing circuit, number 24) which can be sealed in a plastic potting compound. The potting compound can be a room temperature, chemically reactively setting material such as polymer resin.

Figure 3:
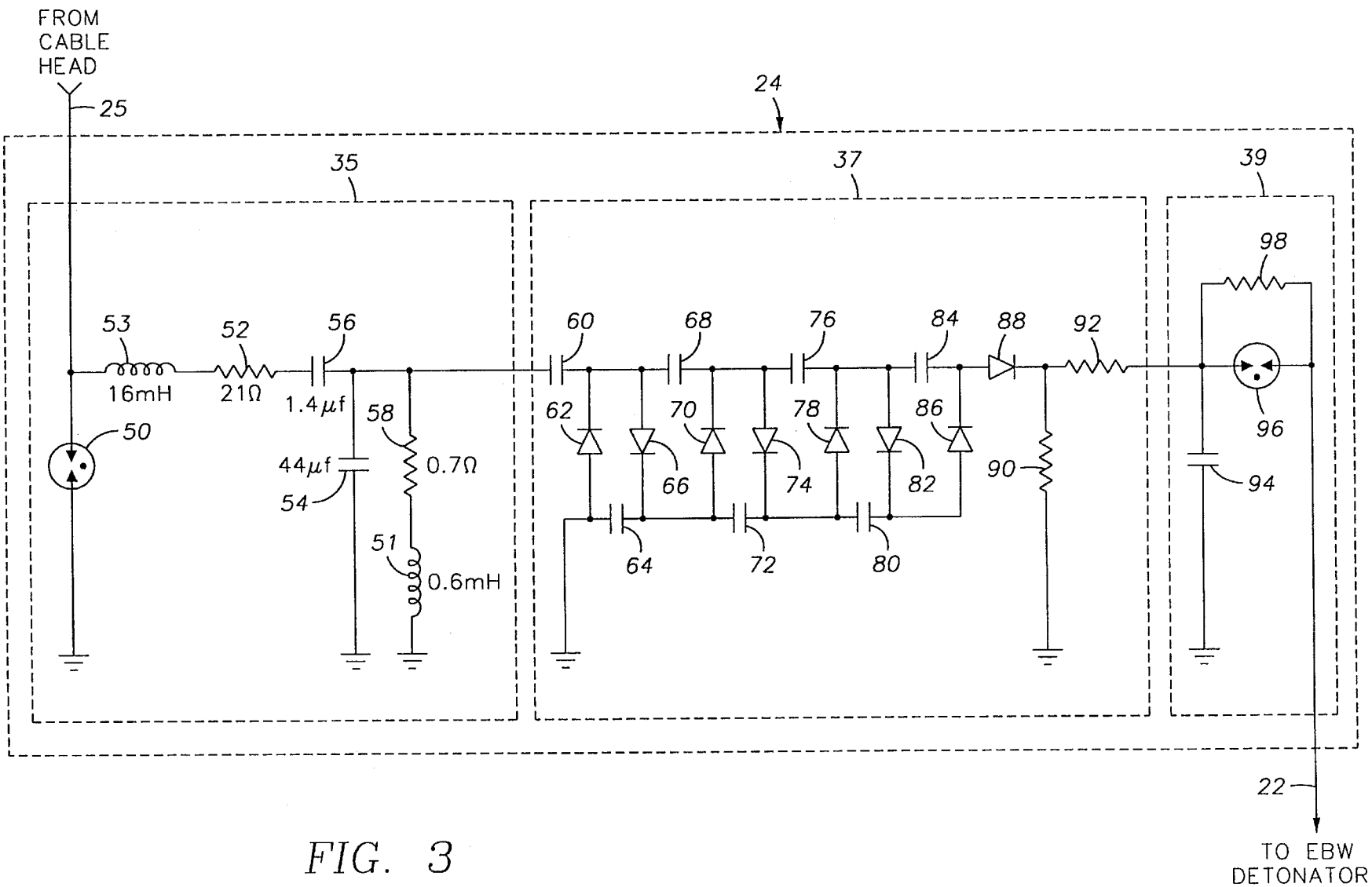
FIG. 3 shows a detailed functional diagram of the firing circuit of the present invention.

FIG. 3 shows the functional components of the firing circuit 24 in more detail as a circuit diagram. The bandpass filter 35 comprises a first surge voltage protector (SVP) 50 which shunts out voltage exceeding a preselected voltage. The first SVP 50 protects against accidental energizing of the detonator 22 by unintentional application of voltages to the cable 18 which may be caused by such electrical sources as lightning strikes. Resistors 52 and 58, capacitors 54 and 56, and inductors 51 and 53 can form the active components of the present embodiment of the bandpass filter 35. The component values selected for the resistors 52, 58, capacitors, 54, 56 and inductors 51, 53 shown in FIG. 3 provide a passband frequency of about 1 kHz and a "cut-off" response of about −30 dB at 500 Hz and 2 kHz. Alternating current (AC) at a frequency near the passband frequency will readily pass through the filter 35 to the voltage multiplier circuit 37, but AC having frequencies higher or lower than the −30 dB "cut-off" frequencies will be substantially blocked by the filter 35. The passband and cut-off response of the filter 35 is preferably narrow enough to enable activation of the firing circuit 24 by application of substantially monochromatic AC at the passband frequency to reduce the possibility of unintended activation of the firing circuit 24. The response characteristics of the filter 35 in the present embodiment are selected to provide sufficiently narrow passband response but also enable the filter 35 to be constructed from resistors 52, 58, capacitors 54, 56 and inductors small enough in size to fit in the gun carrier 10. Other passband frequencies and cut-off response characteristics can be selected for the filter 35 by selecting different values of resistors, capacitors and inductors. Methods of selecting values of capacitors, resistors and inductors to obtain the desired filter response are known in the art.

The passband frequency and the cut-off characteristics of the filter 35 preferably are selected to exclude passage of AC having frequencies of sources of electrical power already present at the wellbore location. For example, the passband frequency of the bandpass filter 35 can be chosen to exclude the frequency of a general utility electric power source, typically 50 or 60 Hz. Exclusion of the utility power source frequency can reduce the possibility of accidental activation of the firing circuit by unintended application of utility line voltage to the cable 18. The passband frequency of the filter 35 should also be selected to fall within the passband response of the cable 18, which as is known in the art typically has a −30 dB response cut-off at frequencies above about 80 to 100 kHz.

AC at a frequency which can pass through the filter 35 is rectified and multiplied in the voltage multiplier 37. Diodes 62, 66, 70, 74, 78, 82, 86 half-wave rectify the AC and apply the rectified voltage to capacitors 60, 64, 68, 72, 76, 80, 84 which are connected in series.

The multiplied voltage output from the multiplier 37, which is about 1600 volts with a voltage input to the multiplier 37 of 200 volts, is conducted to the discharge circuit 39 through a current-limiting resistor 92. Another resistor 90 bleeds off any charge remaining in the system when no power is applied to the filter 35. The discharge circuit 39 comprises a second SVP 96 which conducts at about 1500 volts, and a high-voltage capacitor 94 which stores the applied voltage from the multiplier 37 until the conduction threshold voltage of the second SVP 96 is exceeded. When the voltage on the high-voltage capacitor 94 exceeds the conduction threshold of the second SVP 96, the current stored in the high-voltage capacitor 94 is discharged through the EBW (not shown in FIG. 3), causing detonation.

A test resistor 98 can be connected in parallel to the second SVP 96 so the voltage in the discharge circuit 39 can be monitored for testing purposes without exposing the system operator to potentially hazardous high voltages.

DESCRIPTION OF ALTERNATIVE EMBODIMENTS

The bandpass filter 35 can also be a digital filter comprising a microprocessor (not shown) which samples the applied electrical power at spaced apart time intervals and compares the rate of change of the voltage to a programmed amount of rate of change of voltage. If a match is found, the applied power is passed through the filter. This type of digital filter is known in the art. The digital embodiment of the bandpass filter 35 is typically includes programmable cut-off characteristics. The digital bandpass filter can be programmed to have cut-off characteristics similar to the analog filter in the first embodiment of the invention, for example, a 1 kHz passband filter can have −30 dB cut-off at 500 Hz and −30 dB cutoff at 2 kHz. It is to be understood that the digital filter can also be programmed to have extremely "sharp" cut-off characteristics, for example, a 1 kHz passband filter could have −30 dB cut-offs of 900 and 1,100 Hz. A particular advantage of the digital filter is that sharp cut-off response is possible while maintaining component sizes compatible with insertion of the filter 35 in the gun assembly (10 in FIG. 1).

Figure 4:
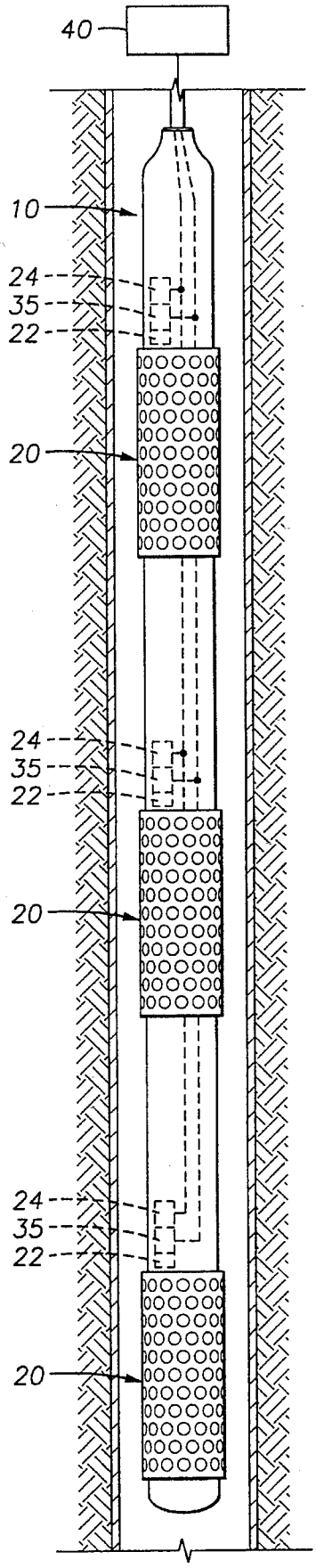
FIG. 4 shows a perforating gun assembly having a plurality of detonating circuits according to the present invention.

FIG. 4 shows an embodiment of the invention including a plurality of gun carriers 20 and a plurality of firing circuits 24, each having a different passband frequency filter 35, forming part of the same gun assembly 10. The gun assembly in FIG. 4 can be used for perforating a plurality of desired formations (shown as 13 in FIG. 1). Detonation of a selected gun carrier 20 is performed by charging the cable 18 with AC having a frequency which substantially matches the passband frequency of the bandpass filter 35 in the gun carrier 20 which is desired to be detonated.

We claim:

1. A firing circuit for activating an exploding bridegwire detonator comprising:

a bandpass filter tuned to a preselected frequency, said filter connected to a source of alternating current, said source of alternating current substantially at said preselected frequency;

a voltage multiplier connected to said bandpass filter;

a discharge circuit connected to said voltage multiplier, said discharge circuit comprising a charging circuit and a voltage threshold switch, wherein said switch remains nonconductive until a voltage building in said charging circuit, resulting from output of said voltage multiplier, exceeds a predetermined threshold, whereupon said switch becomes conductive, enabling energy stored in said charging circuit to activate said detonator.

2. The apparatus as defined in claim 1 wherein said bandpass filter comprises a tuned resistor-capacitor network.

3. The apparatus as defined in claim 1 wherein said bandpass filter comprises a digital filter.

4. A selective firing apparatus for activating a selected exploding bridgewire detonator in an assembly comprising a plurality of exploding bridgewire detonators, said selective firing apparatus comprising a plurality of firing circuits, each of said plurality of firing circuits connected to one of said plurality of detonators, each of said plurality of firing circuits comprising:

a bandpass filter tuned to a different preselected alternating current frequency, said filter connected to a source of detonating current;

a voltage multiplier connected to said bandpass filter; and a discharge circuit connected to said voltage multiplier, said discharge circuit comprising a charging circuit and a threshold voltage switch, wherein said switch remains nonconductive until a voltage building in said charging circuit, resulting from output of said voltage multiplier, exceeds a predetermined threshold, whereupon said switch becomes conductive, enabling energy stored in said charging circuit to activate said selected detonator.

5. The apparatus as defined in claim 4 wherein said bandpass filter comprises a tuned resistor-capacitor network.

6. The apparatus as defined in claim 4 wherein said bandpass filter comprises a digital filter.

* * * * *